United States Patent [19]

Hayashi

[11] 4,064,709

[45] Dec. 27, 1977

[54] WRAP FEEDING DEVICE FOR CIRCULAR KNITTING MACHINE

[75] Inventor: Teishichi Hayashi, Aichi, Japan

[73] Assignee: Nichimen Co., Ltd., Osaka, Japan

[21] Appl. No.: 618,707

[22] Filed: Oct. 1, 1975

[30] Foreign Application Priority Data

Oct. 24, 1974 Japan ..... 49-122672

[51] Int. Cl.[2] ..... D04B 9/32

[52] U.S. Cl. ..... 66/135

[58] Field of Search ..... 66/135, 81, 86 E, 85 A, 66/214

[56] References Cited

U.S. PATENT DOCUMENTS

| | | | |
|---|---|---|---|
| 1,742,255 | 1/1930 | Jennings | 66/135 X |
| 2,045,459 | 6/1936 | Gefaz | 66/135 |
| 2,189,275 | 2/1940 | Agulnek | 66/135 |
| 2,463,751 | 3/1949 | Deans et al. | 66/135 |
| 2,974,505 | 3/1961 | Levin | 66/135 X |
| 2,997,868 | 8/1961 | Engelhard | 66/86 E X |
| 3,592,024 | 8/1971 | Levin | 66/135 X |
| 3,995,454 | 12/1976 | Hayashi et al. | 66/135 |
| 3,995,455 | 12/1976 | Hayashi et al. | 66/135 |

FOREIGN PATENT DOCUMENTS

| | | | |
|---|---|---|---|
| 208,971 | 4/1908 | Germany | 66/135 |

*Primary Examiner*—Mervin Stein
*Assistant Examiner*—A. M. Falik
*Attorney, Agent, or Firm*—Allison C. Collard

[57] ABSTRACT

A wrap feeding device for a circular knitting machine comprising a support ring and a yarn guide mounted on the support ring and pivotally movable in a horizontal plane, the yarn guide having a front end extension extending outwardly from the support ring over the head of the vertical needle and forming a hole in its front end through which the yarn passes. A cylinder is disposed beneath the support ring concentrically therewith, and a return spring is connected with the yarn guide so as to normally retain the yarn guide in a position deflected toward a direction of rotation of the cylinder. An abutment is disposed in a path of movement of the front end extension of the yarn guide for contacting the yarn guide to cause the yarn guide to return against the return spring and to lap a wrap yarn thereon around the vertical needle over the front half circumference thereof.

7 Claims, 6 Drawing Figures

WRAP FEEDING DEVICE FOR CIRCULAR KNITTING MACHINE

The present invention relates to a wrap feeding device for circular knitting machines.

It is an object of the present invention to provide an improved wrap feeding device which is simple in construction, smoothly operable and free of failures and errors.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 6:
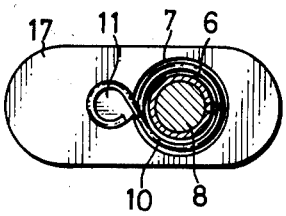

FIG. 6 is plan view of the block 17 showing how the return spring 10 fits around the tubular portion 6.

Figure 1:
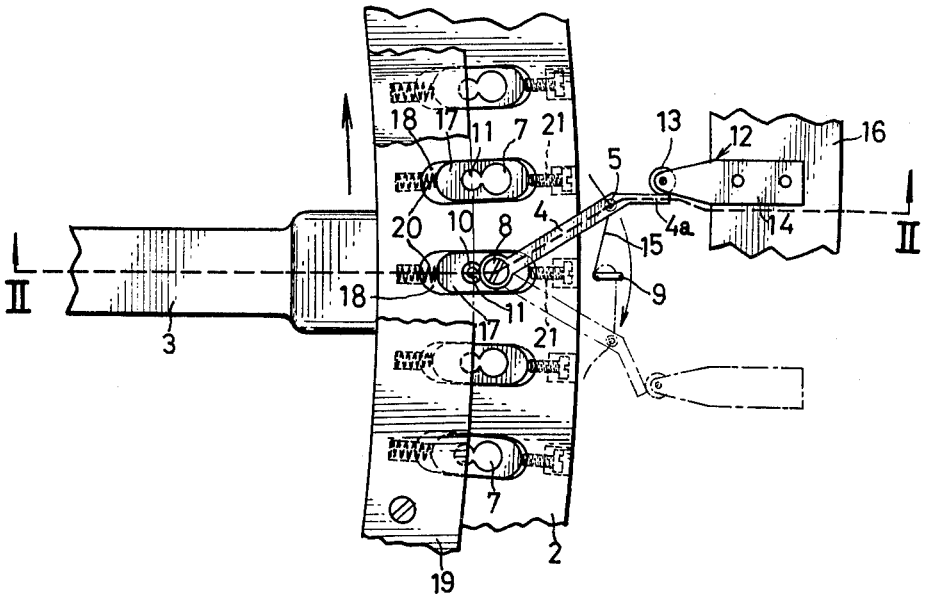
FIG. 1 is a partly broken away plan view of a wrap feed device of the present invention.
Figure 2:
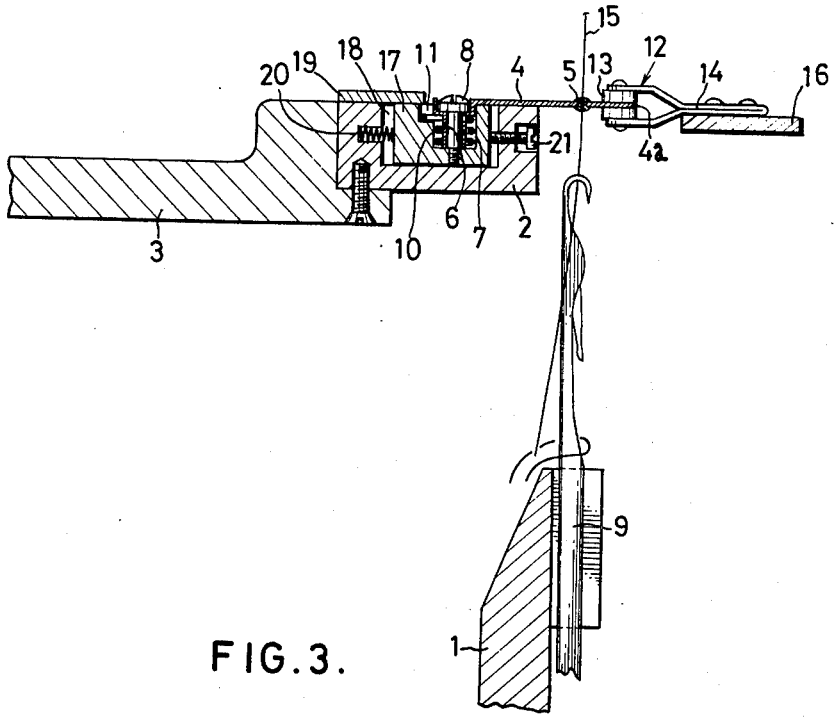
FIG. 2 is a section taken along the lines II—II of FIG. 1.
Figure 3:
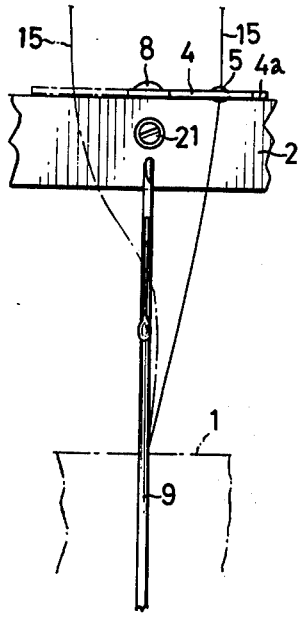
FIG. 3 is a front view thereof.
Figure 4:
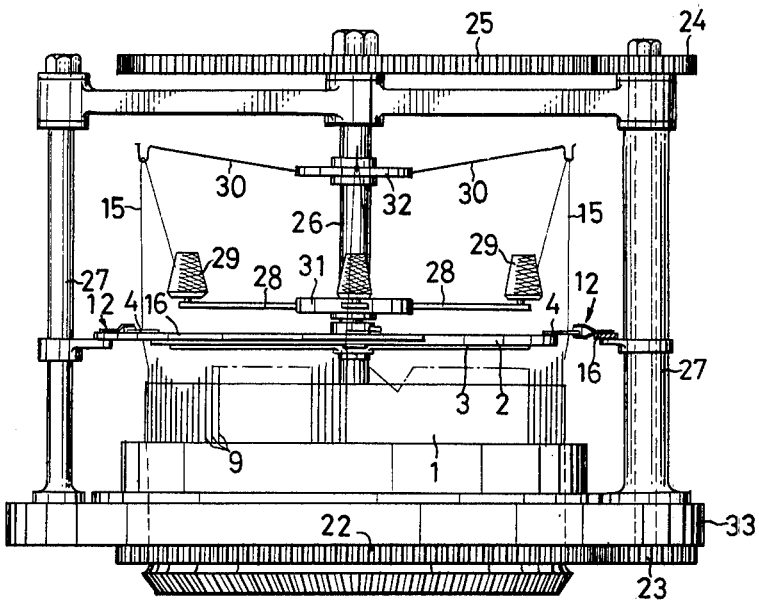
FIG. 4 is an overall front view showing a circular knitting machine equipped with the device of this invention.
Figure 5:
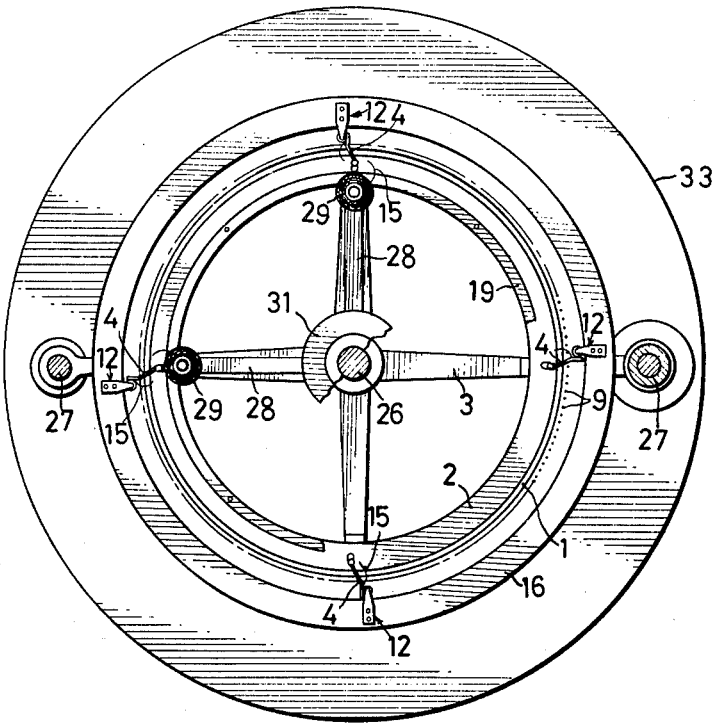
FIG. 5 is a plan view partly broken away and showing the same.

Referring now to the drawings, indicated at 1 is a cylinder and at 2 a support ring disposed above the cylinder 1 concentrically therewith and connected to the rotatable center shaft 26 of a knitting machine by an arm 3. The ring 2 is adapted to rotate with the cylinder 1 by means of gears 22, 23, 24 and 25. A yarn guide 4 for feeding a wrap yarn is formed with a hole 5 for passing therethrough in its front end, and has at its base end, a tubular portion 6. The tubular portion 6 fits in a recess 7 in the support ring 2, and a screw 8 freely extending through the tubular portion 6 is screwed into the support ring 2. The yarn guide is therefore pivotally movable about the screw 8 in a horizontal plane. The yarn guide 4 extends outwardly from the support ring 2 over the head of a vertical needle 9 on the cylinder 1. The front end of the yarn guide 4 is bent at an angle to provide a contact portion 4*a*. A helical return spring 10 fits around the tubular portion 6 of the yarn guide 4 and has a lower end fixed to the tubular portion 6 and an upper end bent into an S-shape. The upper end of the spring 10 fits and is retained in a spring holding recess 11 having a smaller diameter than the recess 7 and communicates therewith. The return spring 10 acts on the yarn guide 4 to bias the guide in the direction of rotation of the cylinder 1. The spring is adapted, at the extremity of its loose condition, to hold the yarn guide 4 at a position deflected from a radial line of the cylinder 1 toward the direction of rotation thereof as seen in FIG. 1. An abutting member 12 for turning the yarn guide 4 comprises a vertical roller 13 covered with hard rubber, and arms 14 supporting the roller 13, and is so disposed that the roller 13 is positioned in the path of movement of the front end contact portion 4*a* of the yarn guide 4. The abutting members 12 are disposed around the circumference of the knitting machine, one provided for each position where the wrap yarn 15 is fed to the needle 9.

The abutting members 12 are mounted on a mounting ring 16 surrounding the yarn guide support ring 2 and supported by a frame 27 on the base 33 of the machine. The wrap yarn 15 is unwound from a spool 29 on the arm 28 of a support 31, passed over the arm 30 of a yarn guiding member 32 and led to the yarn guide 4. Like the yarn guide support ring 2, the spool support 31 and yarn guiding member 32 are fixedly mounted on the rotatable center shaft 26 and are rotatable with the cylinder 1.

By virtue of the operation of the knitting machine, the yarn guide support ring 2 in the above device rotates in the same direction as, and at a speed equal to the cylinder 1. When the vertical needle 9 moves up to the position where the ground yarn is fed, namely to the yarn feeding position, the front end contact portion 4*a* of the yarn guide 4 comes into contact with the roller 13 on the abutting member 12, whereby the yarn guide 4 is turned, as the support ring 2 further rotates about the screw 8 in the direction opposite to the direction of rotation of the ring 2 against the return spring 10. The yarn guide 4 continuously turns above the vertical needle 9 to which the wrap yarn 15 is to be fed from one side of the needle to the other side thereof as illustrated in the dot-and-dash line in FIG. 1. Consequently, the wrap yarn 15 passing through the hole 5 laps around the needle 9 approximately over the front half of its periphery and is thereby placed into the hook of the needle.

The vertical needle 9 thus fed with the wrap yarn 15 along with the weft yarn descends to knit a weft knitted fabric with the ground yarn and, at the same time, to plate the looped weft with the wrap yarn.

When the wrap yarn 15 has been completely fed, the yarn guide 4 is released from the abutting member 12, whereupon the return spring 10 returns the yarn guide to the usual standby position.

For ease of illustration, the embodiment described is such that the wrap yarn 15 is fed to one vertical needle 9 by one yarn guide 4. However, a plurality of yarn guides 4 may be provided at the yarn feeding position, or one yarn guide 4 may be adapted to feed a wrap yarn 15 to at least two adjacent vertical needles 9 at the same time.

The number of the vertical needles 9 to which the wrap yarn 15 is fed at the same time by a single horizontal stroke of one yarn guide 4 can be varied as desired for example by the following structure. The construction including the parts 6, 7, 8, 10 and 11 and associated with the yarn guide 4 is incorporated into a single block 17, which is movably placed in a radially elongated recess 18 in the support ring 2. The block 17 is retained in position, with its top surface covered with a ring 19 fixed to the ring 2. The block 17 is outwardly biased by a helical spring 20 provided at the inner end of the recessed portion 18, whilst an adjusting screw 21 is screwed into the outer periphery of the support ring 2 against the outer end of the block 17. The screw 21 is operated to displace the block 17 radially of the support ring 2 and to thereby vary the stroke of the yarn guide 4 relative to the plane in which the vertical needles 9 are arranged. In this way, the number of the vertical needles 9 to which the wrap yarn 15 is fed at the same time is variable as desired.

For example, as the block 17 moves outwardly in a radial direction, the contact portion 4*a* of the yarn guide 4 gets into deeper (closer) and deeper contact with the abutting member 12. On the contrary, the contact portion 4*a* will get into more and more shallow contact with the abutting member 12 as the block 17 moves inwardly in a radial direction. The yarn guide 4 continues to swing from the first time when its contact portion 4*a* is abutted against the abutting member 12 until the contact portion 4*a* ceases its contact with the abutting member 12 and then is released therefrom. Consequently, the largeness of the swing angle of the yarn guide, namely of its stroke, increases or decreases in proportion to the contact degree of the contact portion 4*a* with the abutting member 12. Thus, the number of the vertical needles to be fed with the wrap yarn 15 will gradually increase along with the increase of the swing angle while it will decrease by degrees along with the decrease of the same.

To facilitate determination of the number and position of the yarn guides 4, the support ring 2 in the embodiment has a number of yarn guide mounting recesses 7 and 11 at a predetermined spacing.

Generally the wrap feeding device of this invention is incorporated into circular knitting machines for producing weft knitted fabrics. Courses of wrap knitting are incorporated into a weft knitted structure while it is being formed on the knitting machine to thereby produce the desired pattern or to strengthen the fabric.

According to the invention described above, the yarn guide 4 for feeding the wrap yarn is rotatable about the axis of the vertical needle 9 by means of contact with the abutting member 12 to thereby feed the wrap yarn 15 to the needle 9. Therefore the present device comprises a greatly reduced number of parts, has a materially simplified construction, consequently is very inexpensive to make and includes an extremely simple yarn guide actuating mechanism which assures a very smooth yarn feeding operation free of any failure or error. Since the wrap yarn can be fed without being subjected to a sudded tension, it is possible to make a knitted fabric having wrap yarns incorporated therein with uniform and beautiful loops.

While only several embodiments of the present invention have been shown and described, it will be obvious to those skilled in the art that many changes and modifications may be made thereunto without departing from the spirit and scope of the invention.

What is claimed is:

1. A wrap feeding device for circular knitting machines, having a vertical needle, comprising:

a support ring having a cavity formed therein;

a rotatable cylinder disposed beneath said support ring concentrically therewith;

yarn guide means, including a movable block having first and second recesses mounted in said cavity of said support ring for adjustable movement therein radially of said support ring, an arm one end of said arm including a tubular portion received within said first recess of said block, and the other end of said arm including an angled portion in the form of a dog-leg, said angled portion having a hole forming a yarn passage, said yarn passage extending substantially vertically through said other end at said angled portion, screw means fitted within said tubular portion and pivotably connecting said arm to said movable block for movement in a horizontal plane;

return spring means, including a helical spring fitting around said tubular portion in said first recess and comprising a lower end fixed to said tubular portion, and an upper end received in said second recess to act on said yarn guide and bias said arm in the direction of rotation of said cylinder;

abutting means disposed in a path of movement of said dog-leg of said yarn guide for contacting thereof to cause the yarn guide to move against said return spring means and to lap a wrap yarn thereon around the vertical needle over the front half circumference of the needle;

a helical spring held in position by said support ring and urging said block toward said abutment means; and an adjustable locking screw received in said support ring and bearing on said block on a side opposite to said helical spring cooperating therewith, to permit displacement of said block radially of said support ring, thereby varying the stroke of said arm.

2. A device as claimed in claim 1, in which the abutting means comprises a roller mountable to rotate about a vertical axis and engage the dog-leg of the guide means, during displacement through a portion of its operation.

3. A device as claimed in claim 1, wherein said second recess has a smaller diameter than said first recess and communicates therewith;

said upper end of said return spring being bent into an S-shape.

4. A wrap feeding device for a circular knitting machine, having a vertical needle, comprising:

a support ring having a cavity formed therein;

a rotatable cylinder disposed beneath said support ring concentrically therewith;

yarn guide means including a movable block, having first and second recesses, mountable in said cavity of said support ring, an arm having a tubular portion at its rear end, which tubular portion is receivable and securable in said first recess of said block by means of a screw, so as to permit pivotable movement of said arm thereon in a horizontal plane and radially of said support ring, said arm having a forward end extension extending outwardly from said support ring over the head of the vertical needle and having a hole in its forward end, through which yarn passes;

return spring means fitted within said first recess of said block and surrounding said tubular portion, and having one end associated therewith and another end received in said second recess, so as to normally retain said arm in a position deflected toward a direction of rotation of the cylinder; and abutting means disposed in a path of movement of said forward end extension of said arm for contacting said arm and causing said arm to move against the return force of said return spring means, and to lay a wrap yarn thereon around the vertical needle over the front half and circumference of the needle, said support ring including an urging spring held therein bearing against one side of said block and an adjustable locking screw, held therein and bearing against the other side of said block for locking said block in position in said cavity, said urging spring urging said block in a radial direction toward said abutting means.

5. A device as claimed in claim 4, in which the return spring means is a coiled return spring locatable around the tubular portion of said arm and has a lower end securable to the tubular portion and an upper, substantially S-shaped end with a portion thereof retainably locatable in said second recess extending from and communicating with the first recess.

6. A device as claimed in claim 4, in which the arm is angled in the form of a dog-leg and said yarn passage hole extends substantially vertically through the angled region.

7. A device as claimed in claim 4 wherein said abutting means comprises:

a pair of spaced arms mounted on a mounting ring surrounding said support ring and a roller carried between said arms mounted thereto for rotation about a vertical axis to engage said front end extension during displacement through a portion of its operation.

* * * * *